US008091884B2

(12) United States Patent
Furukawa et al.

(10) Patent No.: US 8,091,884 B2
(45) Date of Patent: Jan. 10, 2012

(54) TRANSPORT DEVICE, OVERLAP FEED SIGN DETECTION DEVICE, AND COMPUTER READABLE MEDIUM

(75) Inventors: Shigehiro Furukawa, Kanagawa (JP); Koji Adachi, Kanagawa (JP); Kaoru Yasukawa, Kanagawa (JP); Norikazu Yamada, Kanagawa (JP); Koki Uwatoko, Kanagawa (JP); Tetsuichi Satonaga, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 84 days.

(21) Appl. No.: 12/553,617

(22) Filed: Sep. 3, 2009

(65) Prior Publication Data

US 2010/0225052 A1 Sep. 9, 2010

(30) Foreign Application Priority Data

Mar. 9, 2009 (JP) ..... 2009-054663

(51) Int. Cl.
*B65H 1/22* (2006.01)

(52) U.S. Cl. ..... 271/37; 271/110

(58) Field of Classification Search ..... 271/37, 271/110

See application file for complete search history.

(56) References Cited

U.S. PATENT DOCUMENTS 6,499,732 B1 * 12/2002 Akaba ..... 271/9.09
7,296,794 B2 * 11/2007 Shimazaki ..... 271/259

FOREIGN PATENT DOCUMENTS

| | | |
|---|---|---|
| JP | A-03-056734 | 3/1991 |
| JP | A-9-315618 | 12/1997 |
| JP | A-2000-307786 | 11/2000 |
| JP | A-2005-206307 | 8/2005 |
| JP | A-2006-082889 | 3/2006 |
| JP | A-2007-297149 | 11/2007 |

OTHER PUBLICATIONS

Feb. 8, 2011 Office Action issued in Japanese Patent Application No. 2009-054663 (with translation).

* cited by examiner

*Primary Examiner* — Michael McCullough
(74) *Attorney, Agent, or Firm* — Oliff & Berridge, PLC

(57) ABSTRACT

A transport device includes a feed unit that feeds transport subjects being loaded in a loading portion one by one in a transport direction, a protrusion amount detection unit that detects a protrusion amount of the transport subjects from the loading portion in the transport direction and an overlap feed sign detection unit that detects a sign of occurrence of overlap feed of the transport subjects based on a detection result of the protrusion amount.

8 Claims, 7 Drawing Sheets

TRANSPORT DEVICE, OVERLAP FEED SIGN DETECTION DEVICE, AND COMPUTER READABLE MEDIUM

CROSS-REFERENCE TO RELATED APPLICATIONS

This application is based on and claims priority under 35 USC 119 from Japanese Patent Application No. 2009-054663 filed on Mar. 9, 2009.

BACKGROUND

1. Technical Field

The present invention relates to a transport device, an overlap feed sign detection device, and a computer readable medium.

2. Related Art

In a related-art, there is a sheet transport device which feeds and transports sheets being loaded one by one in a transport direction.

When transport subjects which are being loaded are fed one by one in the transport direction, if a state where overlap feed of the transport subjects easily occurs can be detected in advance, for example, it becomes significant since countermeasures, such as replacement of the transport subjects or parts of the transport device, or the like, are possible.

SUMMARY

According to an aspect of the invention, there is provided a transport device including: a feed unit that feeds transport subjects being loaded in a loading portion one by one in a transport direction; a protrusion amount detection unit that detects a protrusion amount of the transport subjects from the loading portion in the transport direction; and an overlap feed sign detection unit that detects a sign of occurrence of overlap feed of the transport subjects based on a detection result of the protrusion amount.

BRIEF DESCRIPTION OF THE DRAWINGS

Exemplary embodiments of the invention will be described in detail based on the following figures, wherein.

DETAILED DESCRIPTION

Hereinafter, exemplary embodiments of the invention will be described with reference to FIGS. 1 to 9.

First Exemplary Embodiment

Figure 1:
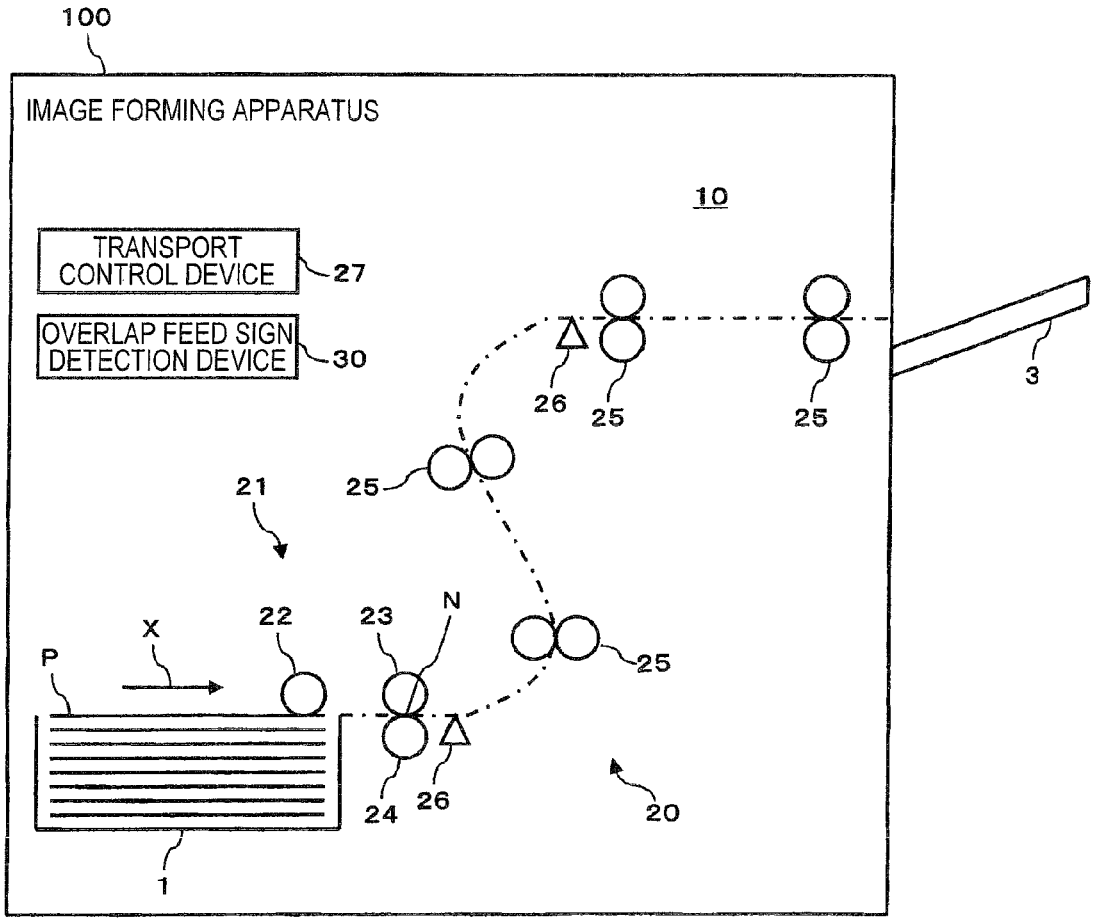
FIG. 1 is a schematic view showing an example of a configuration of an image forming apparatus including a transport device according to an exemplary embodiment.

FIG. 1 is a schematic view showing an example of a configuration of an image forming apparatus 100 including a transport device 20 according to the first exemplary embodiment. The image forming apparatus 100 is an apparatus, such as a copy machine, a printer, a facsimile machine, or the like, which forms an image on a recording medium P (hereinafter, referred to as "sheet"), such as a sheet or the like, for example, an electrophotographic apparatus which performs printing by an electrophotographic method. The image forming apparatus 100 may use a different printing method, such as an ink jet method or the like. Referring to FIG. 1, the image forming apparatus 100 includes an image forming section 10 and a transport device 20.

The image forming section 10 forms an image on a sheet in accordance with an electrophotographic process. The image forming section 10 is widely known, and the detailed configuration thereof will not be shown and described in detail. Briefly, the image forming section 10 usually includes a photosensitive member, a charging device, an exposure device, a developing device, a transfer device, and a cleaning device, which are provided around the photosensitive member, and a fixing device. An electrostatic latent image is formed on the photosensitive member by the charging device and the exposure device, and is visualized by the developing device (a toner image is formed). The toner image on the photosensitive member is transferred onto the sheet by the transfer device. The transferred toner image is fixed onto the sheet by the fixing device.

The transport device 20 has a feed mechanism 21 which feeds transport subjects (in this case, sheets) being loaded in a loading portion 1 one by one in a transport direction (an arrow X direction in FIG. 1). In the example of FIG. 1, the loading portion 1 is a sheet feed tray in which the sheets are accommodated. While only one loading portion 1 is shown in FIG. 1, a plurality of loading portions 1 may be provided. The loading portion 1 is not limited to the sheet feed tray, and for example, it may be a manual feed tray in which the sheets are placed or the like.

Specifically, the feed mechanism 21 includes a transport unit which gives a force of the transport direction to a sheet to be transported (for example, an uppermost sheet) so as to transport the sheet to be transported in the transport direction, and a separating unit which gives a force of a direction opposite to the transport direction to a sheet which is unintentionally fed from the loading portion 1 along with the sheet to be transported at a separating portion so as to separate the unintentionally fed sheet from the sheet to be transported.

In one aspect, as shown in FIG. 1, the feed mechanism 21 includes a pickup roller 22 which is disposed opposite the uppermost sheet from among the sheets being loaded in the loading portion 1, a feed roller 23 which is provided on a downstream side in the transport direction of the pickup roller 22, and a separating roller (retard roller) 24 which is pressed against the feed roller 23 to form a separating portion (nip portion) N with the feed roller 23.

The pickup roller 22 is driven to rotate while being in contact with the uppermost sheet, and feeds the uppermost sheet in the transport direction. The pickup roller 22 may be driven to be switched between a contact state with the uppermost sheet and a non-contact state by an actuator, such as a solenoid or the like.

The feed roller 23 is driven to rotate in the same rotation direction as the pickup roller 22, that is, a direction in which the sheet is further transported forth, and transports the sheet fed by the pickup roller 22 in the transport direction.

When a subsequent sheet is unintentionally fed from the loading portion 1 by the pickup roller 22 along with the uppermost sheet, the separating roller 24 gives a force of a direction opposite to the transport direction to the unintentionally fed sheet at the separating portion N so as to separate the unintentionally fed sheet from the uppermost sheet.

Specifically, the separating roller 24 is given rotary torque of a direction opposite to the transport direction of the sheet through a torque limiter. When no sheet exists in the separating portion N, and when only one sheet is fed in the separating portion N, rotary torque which exceeds the limit value of the torque limiter is applied to the separating roller 24, and the separating roller 24 rotates in the transport direction along with the feed roller 23. Meanwhile, when two or more sheets are fed in the separating portion N, the separating roller 24 rotates in a direction opposite to the transport direction of the sheet, and rolls a sheet, which is in contact with the separating roller 24, back toward the loading portion 1. Accordingly, the uppermost sheet which is in contact with the feed roller 23 is transported in the transport direction by the rotation of the feed roller 23, and the sheet that is unintentionally fed along with the uppermost sheet and enters the separating portion N is rolled back in a direction opposite to the transport direction by the operation of the separating roller 24.

The detailed configuration of the feed mechanism 21 is not limited to that described above. For example, a separating pad may be used, instead of the separating roller 24. A separating member, such as the separating roller 24 or the like, may be pressed into contact with the pickup roller 22.

In the example of FIG. 1, the transport device 20 further has a transport mechanism that transports a sheet fed by the feed mechanism 21 to a transfer portion, transports the sheet after transfer to a fixing section, and discharges the sheet after fixing to a discharge tray 3. Specifically, the transport device 20 has at least one transport roller 25 provided in a transport path for transporting the sheet from the feed mechanism 21 along the transport path. At least one transport roller 25 may include a registration roller for adjusting the position of the sheet, for example. The transport device 20 has at least one sheet sensor 26 for sheet transport control which is provided in the transport path to detect presence/absence of the sheet.

The transport device 20 includes a transport control device 27 which controls the transport of the sheet. Specifically, the transport control device 27 controls the operation of the feed mechanism 21 or the transport roller 25 based on the output from the sheet sensor 26 or the like so as to control the transport of the sheet.

In the transport device 20 configured as above, when the separation performance of the separating unit is degraded (for example, the frictional coefficient of the separating roller 24 is lowered) or when the absorption force or frictional resistance between sheets is large, there occurs a phenomenon (that is, overlap feed) that multiple sheets are fed from the feed mechanism 21 in an overlap manner. If the overlap feed occurs, for example, the overlap feed is detected by the transport control device 27, and the transport operation of the sheet stops.

Figure 2:
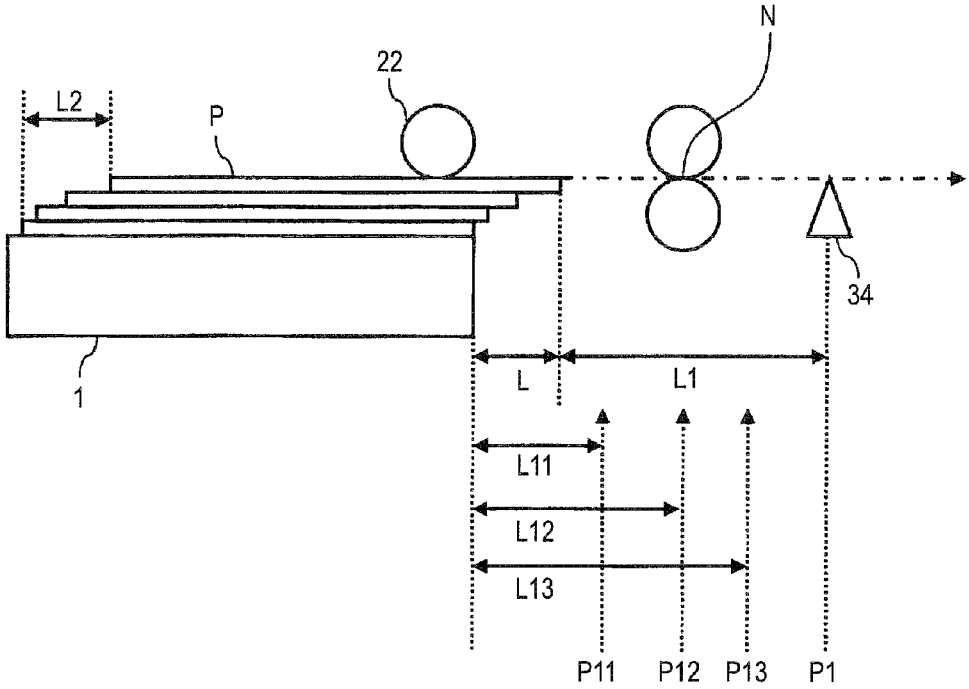
FIG. 2 is a diagram showing an example where a sheet which is loaded in a loading portion protrudes in front of a separating portion.
Figure 3:
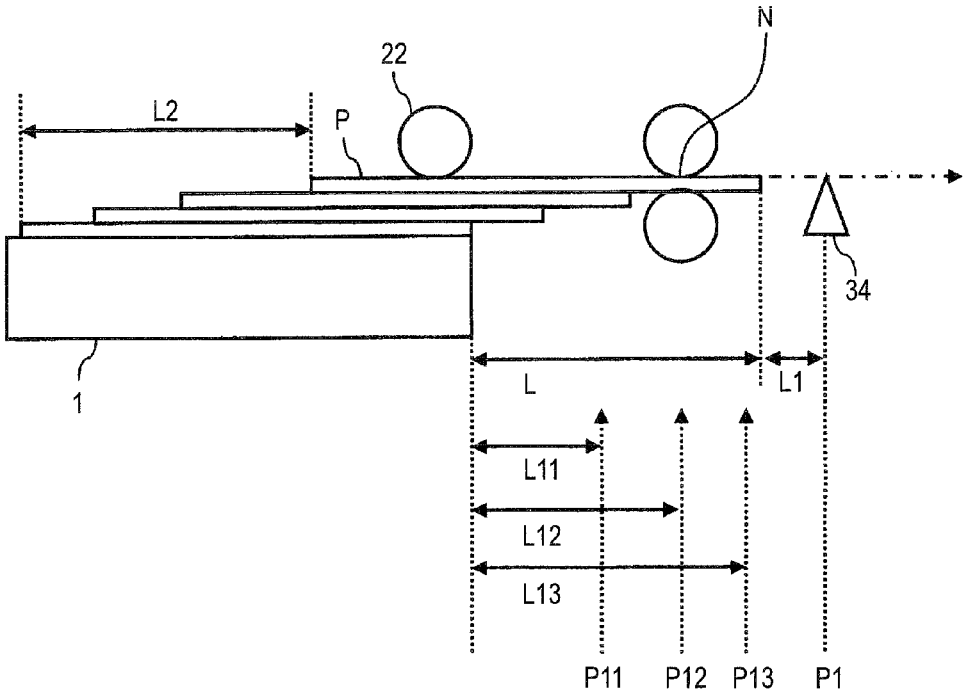
FIG. 3 is a diagram showing an example where a sheet which is loaded in a loading portion protrudes beyond a separating portion.

Before the overlap feed occurs, as shown in FIGS. 2 and 3, there is a phenomenon that a sheet next to a fed sheet protrudes from an end surface of the loading portion 1 on the transport direction side. FIG. 2 shows an example where a sheet being loaded in the loading portion 1 protrudes in front of the separating portion N. FIG. 3 shows an example where a sheet being loaded in the loading portion 1 protrudes beyond the separating portion N.

In the first exemplary embodiment, from a viewpoint of prevention of occurrence of transport operation stop due to overlap feed, or the like, the transport device 20 has an overlap feed sign detection device 30 which detects a sign of occurrence of overlap feed of sheets.

In one aspect, the overlap feed sign detection device 30 is realized by a combination of hardware resources and software. Specifically, a program recorded in a recording medium, such as a Read Only Memory (ROM) or the like, is read onto a main storage device (main memory) and executed by a Central Processing Unit (CPU), so various functions of the overlap feed sign detection device 30 are realized. The program may be provided through a computer-readable recording medium, such as a CD-ROM or the like, or may be provided through communication as data signals. Note that the overlap feed sign detection device 30 may be realized only by hardware. Further, the overlap feed sign detection device 30 may be physically realized by a single device or multiple devices. Note that the transport control device 27 may be realized in the same manner as the overlap feed sign detection device 30. The transport control device 27 and the overlap feed sign detection device 30 may be realized by a single device, and for example, may be included in a control device which controls the entire image forming apparatus 100.

Figure 4:
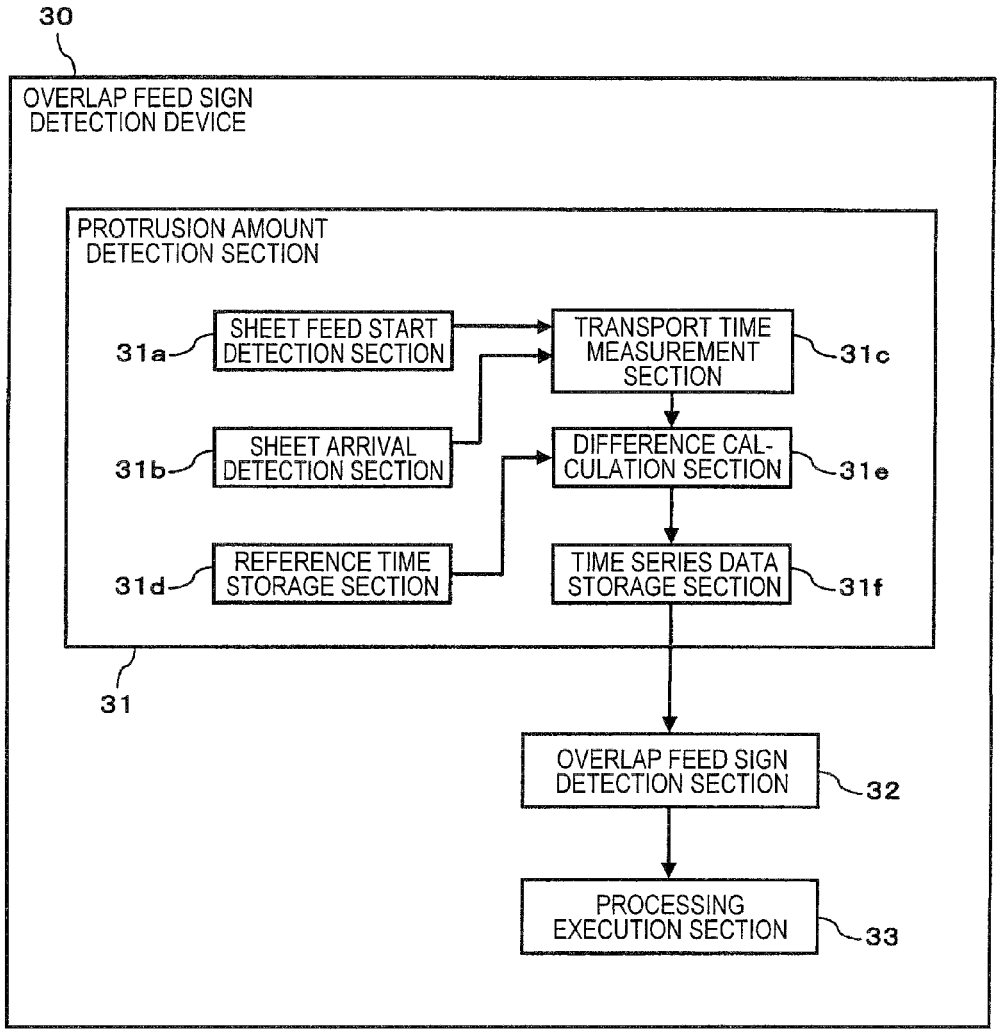
FIG. 4 is a block diagram showing an example of a functional configuration of an overlap feed sign detection device according to a first exemplary embodiment.
Figure 5:
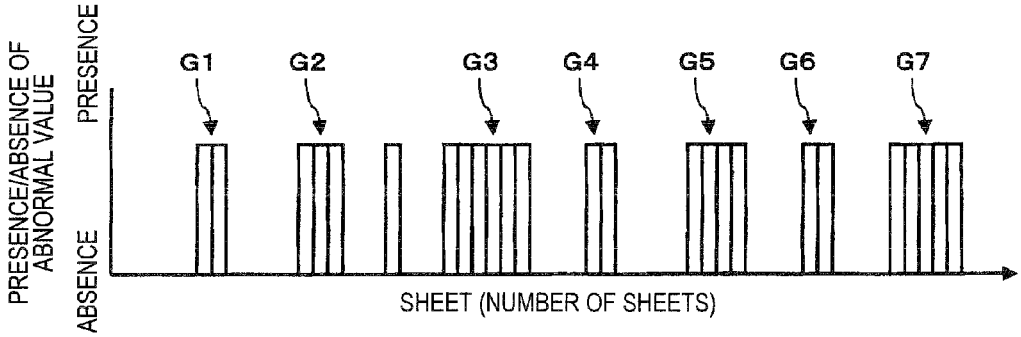
FIG. 5 is a diagram showing an example of a generation pattern of an abnormal value.
Figure 6:
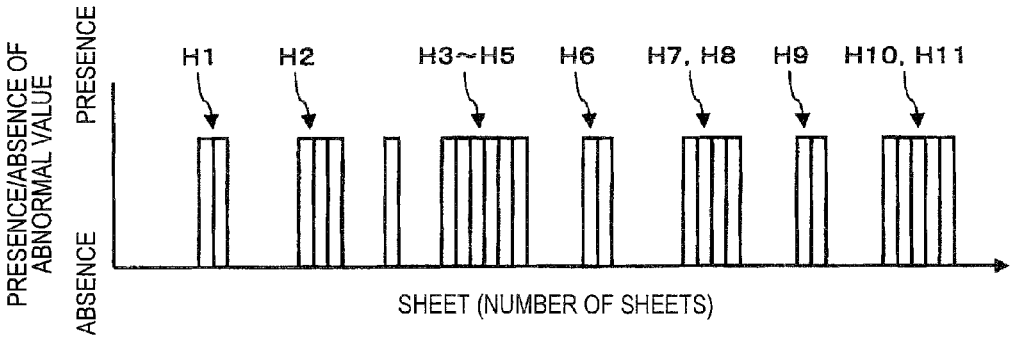
FIG. 6 is a diagram showing an example of a generating pattern of an abnormal value.

FIG. 4 is a block diagram showing an example of a functional configuration of the overlap feed sign detection device 30. Referring to FIG. 4, the overlap feed sign detection device 30 has a protrusion amount detection section 31, an overlap feed sign detection section 32, and a processing execution section 33.

The protrusion amount detection section 31 detects the protrusion amount of the sheet being loaded in the loading portion 1 from the loading portion 1 in the transport direction. For example, in FIGS. 2 and 3, the protrusion amount is expressed as a length L. The protrusion amount detection section 31 may substantially the protrusion amount or acquire information indicative of the protrusion amount.

In one aspect, from a viewpoint of detection of the protrusion amount with simple configuration, the protrusion amount detection section 31 detects a transport time from the feed start of the sheet to the arrival of the sheet at a specific position as information indicative of the protrusion amount. Specifically, as shown in FIGS. 2 and 3, the sheet sensor 34 is disposed at a specific position P1 on the downstream side in the transport direction to detect presence/absence of the sheet, and the protrusion amount detection section 31 measures as the transport time a time from when sheet feed starts until the sheet sensor 34 detects the sheet arrival at the sheet sensor 34. Note that the sheet sensor 26 for transport control may be used as the sheet sensor 34.

The protrusion amount detection section 31 may detect the protrusion amount in other ways. For example, referring to FIGS. 2 and 3, the protrusion amount detection section 31 may detect the protrusion amount L itself by using various sensors, or may detect a transport distance L1 of the sheet to the specific position P1. Further, the protrusion amount detection section 31 may detect a position shift amount L2 of the trailing end of the sheet.

In the example of FIG. 4, the protrusion amount detection section 31 includes a sheet feed start detection section 31*a*, a sheet arrival detection section 31*b*, a transport time measurement section 31*c*, a reference time storage section 31*d*, a difference calculation section 31*e*, and a time series data storage section 31*f*.

The sheet feed start detection section 31*a* detects the sheet feed start by the feed mechanism 21. Specifically, the sheet feed start detection section 31*a* receives an activation signal for the feed mechanism 21 from the transport control device 27. Examples of the activation signal include, for example, a driving start signal of a motor which drives the pickup roller 22 to rotate, an ON signal of a solenoid for brining the pickup roller 22 into contact with the uppermost sheet, and the like.

The sheet arrival detection section 31*b* detects the arrival of a fed sheet at a specific position. Specifically, as shown in FIGS. 2 and 3, the sheet sensor 34 is disposed at the position P1 on the downstream side of the separating portion N in the transport direction to detect presence/absence of the sheet, and the sheet arrival detection section 31*b* receives a detection signal from the sheet sensor 34.

The transport time measurement section 31*c* measures the transport time from the sheet feed start to the sheet arrival at the specific position based on the detection results of the sheet feed start detection section 31*a* and the sheet arrival detection section 31*b*. Specifically, if an activation signal is received by the sheet feed start detection section 31*a*, the transport time measurement section 31*c* starts to measure a time elapsed by using a timer. If the detection signal is received by the sheet arrival detection section 31*b*, the transport time measurement section 31*c* stops the measurement of the time elapsed by the timer, and measures as the transport time the time elapsed from when the activation signal is received until the detection signal is received.

The reference time storage section 31*d* stores the time from the sheet feed start to the sheet arrival at the specific position as a reference time in advance. The reference time is, for example, a time which is preset by an experiment or calculation, and is an ideal transport time.

The difference calculation section 31*e* calculates a difference between the reference time which is stored in the reference time storage section 31*d* and the transport time measured by the transport time measurement section 31*c*. The difference is a time which corresponds to the protrusion amount (in FIGS. 2 and 3, length L) of the sheet being loaded in the loading portion 1, and may be said to be data indicative of the protrusion amount. For example, if a sheet does not protrude, the difference substantially becomes zero. As the protrusion amount of the sheet increases, the difference also increases.

The time series data storage section 31*f* sequentially stores the difference as the calculation result of the difference calculation section 31*e*, and stores time series data of the difference.

The overlap feed sign detection section 32 detects the sign of occurrence of overlap feed of sheets based on the detection result of the protrusion amount detection section 31. Specifically, the overlap feed sign detection section 32 determines presence/absence of the sign of occurrence of overlap feed based on multiple times of detection results of the protrusion amount. For example, the overlap feed sign detection section 32 determines presence/absence of the sign of occurrence of overlap feed based on time series data of the difference which is stored in the time series data storage section 31*f*.

In one aspect, when the occurrence frequency of a protrusion amount (hereinafter, referred to as "abnormal value") which exceeds a prescribed threshold value is higher than a prescribed reference based on the detection result of the protrusion amount, the overlap feed sign detection section 32 determines that there is the sign of occurrence of overlap feed. Referring to FIGS. 2 and 3, for example, a protrusion amount L11 to a specific position P11 in front of the separating portion N, a protrusion amount L12 to a position P12 of the separating portion N, or a protrusion amount L13 to a specific position P13 in front of the sheet sensor 34 beyond the separating portion N is set as the threshold value.

In another aspect, the overlap feed sign detection section 32 obtains the occurrence frequency of the abnormal value and the occurrence frequency of the abnormal value group based on the detection result of the protrusion amount, and when the occurrence frequency of the abnormal value is higher than a prescribed reference and the occurrence frequency of the abnormal value group is higher than a prescribed reference, determines that there is the sign of occurrence of overlap feed.

With regard to the abnormal value group, according to a first definition, when abnormal values are continuously generated M or more times, a series of abnormal values become one abnormal value group. M is a prescribed integer of 1 or more. For example, when abnormal values are generated in a pattern of FIG. 5, if M=2, an abnormal value group of 7 abnormal values G1 to G7 are generated. According to a second definition, N continuous abnormal values become one abnormal value group. N is a prescribed integer of 2 or more. For example, when an abnormal value is generated in a pattern of FIG. 6, if N=2, an abnormal value group of 11 abnormal values H1 to H11 is generated.

When a sheet being loaded in the loading portion 1 protrudes beyond the separating portion N, there is a possibility that the separating unit is deteriorated. Therefore, in one aspect, when a sheet being loaded in the loading portion 1 protrudes beyond the separating portion N as the detection result of the protrusion amount, the overlap feed sign detection section 32 determines that the separating unit (for example, the separating roller 24) is deteriorated.

In this aspect, when the protrusion amount which exceeds the separating portion N is detected even one time, the overlap feed sign detection section 32 may determine that the separating unit is deteriorated. In this case, however, even if it so happens that the sheet protrudes beyond the separating portion N, it may be erroneously determined that the separating unit is deteriorated.

Therefore, in one aspect, when the occurrence frequency of a protrusion amount which exceeds the separating portion N or a specific position on the downstream side in the transport direction from the separating portion N is higher than a prescribed reference, the overlap feed sign detection section 32 determines that the separating unit is deteriorated. For example, referring to FIGS. 2 and 3, with the protrusion amount L12 to the position P 12 of the separating portion N or the protrusion amount L13 to the specific position P13 on the downstream side in the transport direction from the separating portion N as a threshold value, when the occurrence frequency of a protrusion amount (abnormal value) which exceeds the threshold value is higher than a prescribed reference, the overlap feed sign detection section 32 determines that the separating unit is deteriorated.

The phenomenon indicative of deterioration of the separating unit (for example, a phenomenon that the sheets frequently exceed the separating portion) may be the sign of occurrence of overlap feed. Therefore, the overlap feed sign detection section 32 may substantially detect the sign of occurrence of overlap feed by determining presence/absence of deterioration of the separating unit.

Meanwhile, in addition to the phenomenon indicative of deterioration of the separating unit (for example, the phenomenon that the sheets frequently exceed the separating portion), a phenomenon that an excessive protrusion amount is frequency generated while not exceeding the separating portion may be the sign of occurrence of overlap feed. Therefore, the overlap feed sign detection section 32 may perform detection of the sign of occurrence of overlap feed and deterioration determination of the separating unit. For example, when the occurrence frequency of the protrusion amount which exceeds the threshold value L11 is higher than the reference and the occurrence frequency of the protrusion amount which exceeds the threshold value L13 is equal to or lower than the reference, the overlap feed sign detection section 32 determines that there is the sign of occurrence of overlap feed. When the occurrence frequency of the protrusion amount which exceeds the threshold value L13 is higher than the reference, overlap feed sign detection section 32 determines that the separating unit is deteriorated.

The overlap feed sign detection section 32 outputs the detection result of the sign of overlap feed or the result of deterioration determination of the separating unit. In the example of FIG. 4, the overlap feed sign detection section 32 outputs the sign detection result or the deterioration determination result to the processing execution section 33. Note that the overlap feed sign detection section 32 may notify the user or the transport control device 27 of the sign detection result or the deterioration determination result.

When the overlap feed sign detection section 32 detects the sign of occurrence of overlap feed, the processing execution section 33 executes a prescribed processing (for example, a processing for preventing the occurrence of overlap feed) corresponding to the relevant case. Examples of the relevant processing include the processing (a1) to (a3) described below.

(a1) Warning information regarding the sign of occurrence of overlap feed is notified to the user. For example, warning information is displayed on a display screen of a user interface. Examples of warning information include, for example, a message which asks to confirm or replace the sheet, a message which indicates a state where the maintenance of the feed mechanism 21 is needed, a message which asks to replace or clean the parts (for example, the separating roller 24) of the feed mechanism 21.

(a2) Control is performed such that a sheet which protrudes from the loading portion 1 is rolled back toward the loading portion 1. For example, the pickup roller 22 is rotated in a direction opposite to the transport direction to move the sheet being loaded in the loading portion 1 in the direction opposite to the transport direction.

(a3) Control is performed such that the press force between the feed roller 23 and the separating roller 24 increases.

The processing execution section 33 may notify the transport control device 27 of a warning regarding the sign of occurrence of overlap feed, and cause the transport control device 27 to execute the above-described processing (a2) or (a3).

When the overlap feed sign detection section 32 detects deterioration of the separating unit, the processing execution section 33 executes a prescribed processing corresponding to the relevant case. For example, the processing execution section 33 notifies the user of warning information regarding deterioration of the separating unit. Examples of the warning information include, for example, a message which indicates a state where the maintenance of the feed mechanism 21 is needed, a message which asks to replace or clean the parts (for example, the separating roller 24) of the feed mechanism 21, and the like. The processing execution section 33 may execute the above-described processing (a2) and (a3).

Figure 7:
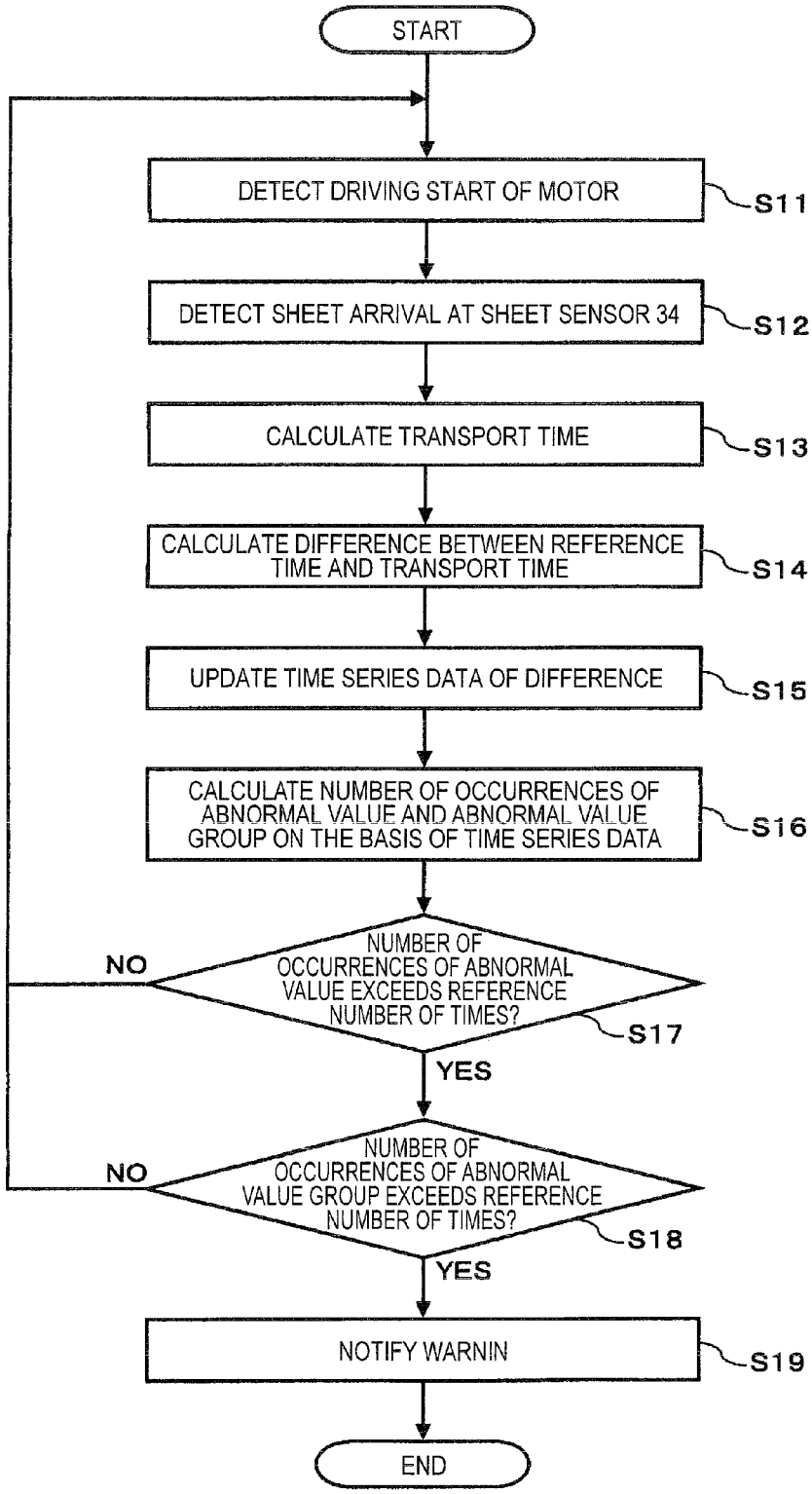
FIG. 7 is a flowchart showing an example of the operation of the overlap feed sign detection device according to the first exemplary embodiment.

FIG. 7 is a flowchart showing an example of the operation of the overlap feed sign detection device 30. Hereinafter, an example of the operation of the overlap feed sign detection device 30 will be described with reference to FIG. 7.

In Step S11, the overlap feed sign detection device 30 detects the driving start of the motor for driving the pickup roller 22. Note that the overlap feed sign detection device 30 is in a standby state until the driving start is detected.

In Step S12, the overlap feed sign detection device 30 detects the sheet arrival at the sheet sensor 34 by using the sheet sensor 34.

In Step S13, the overlap feed sign detection device 30 calculates the transport time from the sheet feed start to the sheet sensor 34 based on the timing of the sheet feed start detected in Step S11 and the timing of the sheet arrival detected in the Step S12.

In Step S14, the overlap feed sign detection device 30 calculates the difference between the reference time which is stored in advance and the transport time calculated in Step S13.

In Step S15, the overlap feed sign detection device 30 accumulates the difference calculated in Step S14. Specifically, the overlap feed sign detection device 30 updates time series data of the difference based on the calculated difference. In this case, the number of time series data is fixed for a predetermined number of times, and the overlap feed sign detection device 30 erases oldest differential data when new differential data is added to time series data. Therefore, time series data retains data for the predetermined number of times from latest data.

In Step S16, the overlap feed sign detection device 30 evaluates the distribution (occurrence frequency) of time series data of the difference updated in Step S15. Specifically, the overlap feed sign detection device 30 specifies a differential value (abnormal value), which exceeds a prescribed threshold value, from among differential values included in time series data, and calculates the number of occurrences of the abnormal value from the predetermined number of times and the number of occurrences of the abnormal value group from the predetermined number of times.

In Step S17, the overlap feed sign detection device 30 determines whether or not the number of occurrences of abnormal values calculated in the Step S16 exceeds the prescribed reference number of times. When the number of occurrences does not exceed the reference number of times (S17: NO), the process returns to Step S11, and when the number of occurrences exceeds the reference number of times (S17: YES), the process progresses to Step S18.

In Step S18, the overlap feed sign detection device 30 determines whether or not the number of occurrences of abnormal value groups calculated in the Step S16 exceeds the prescribed reference number of times. When the number of occurrences does not exceed the reference number of times (S18: NO), the process returns to Step S11, and when the number of occurrences exceeds the reference number of times (S18: YES), the process progresses to Step S19.

In Step S19, the overlap feed sign detection device 30 notifies the user or the transport control device 27 of a warning indicating that the sign of occurrence of overlap feed is detected.

Second Exemplary Embodiment

The absorption force or frictional resistance between the sheets differs in accordance with the sheet types, and accordingly, the protrusion amount of the sheet differs in accordance with the sheet types. Specifically, as the sheet basis weight increases in terms of sheet types, and as surface glossiness increases in terms of sheet materials, the protrusion amount tends to increase. Accordingly, for example, when sheets of a different type from the previous sheets are set in the loading portion 1, if sign detection or deterioration determination is carried out without discriminating the sheet type based on the detection result of the protrusion amount of the current sheets and the detection result of the protrusion amount of the previous sheets, an appropriate result may not be obtained.

In a second exemplary embodiment, an overlap feed sign detection device 40 carries out sign detection or deterioration determination for each type of transport subject. Hereinafter, the overlap feed sign detection device 40 will be described, but descriptions of the same parts as those in the first exemplary embodiment will be omitted or simplified.

Figure 8:
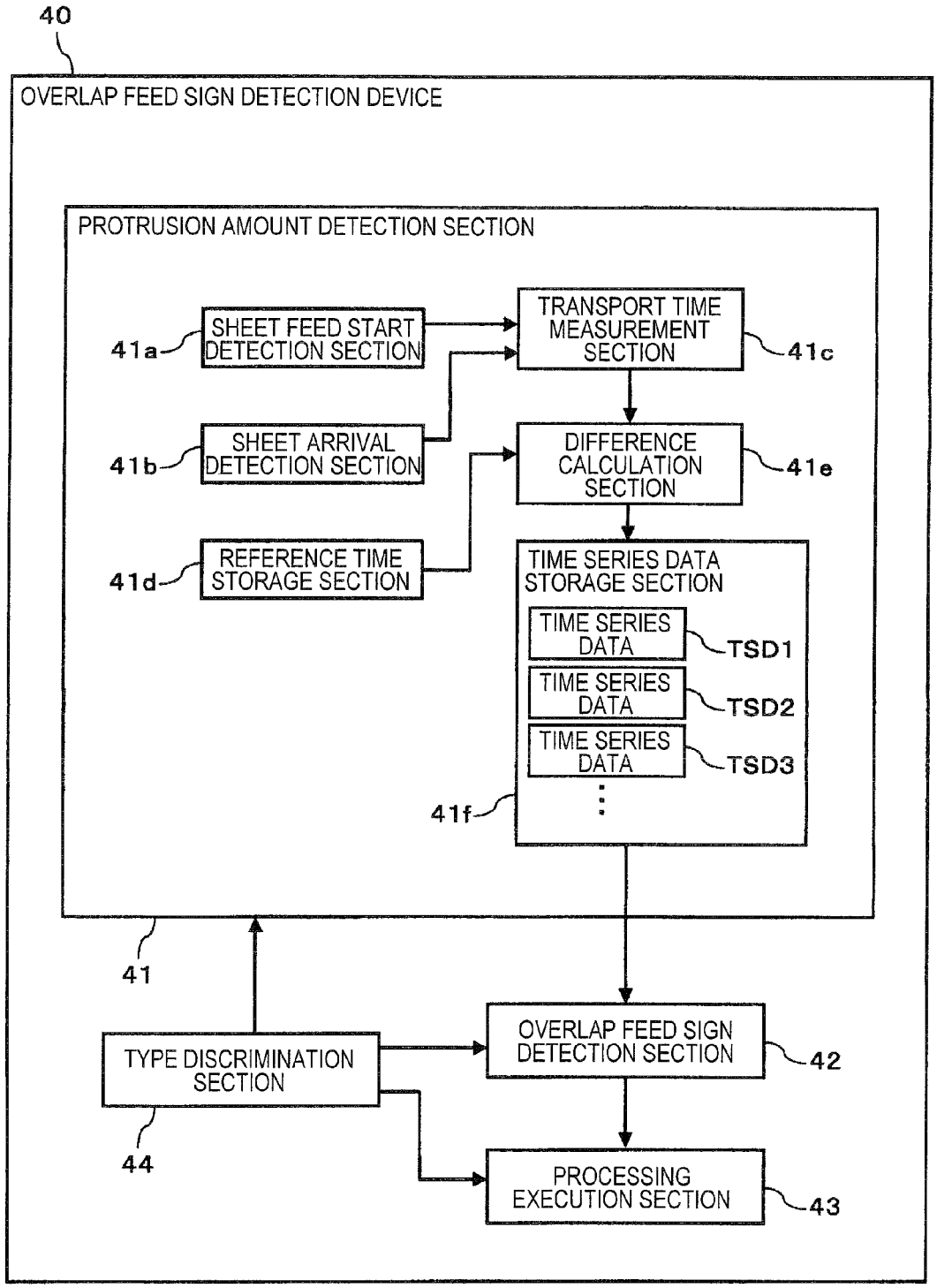
FIG. 8 is a block diagram showing an example of a functional configuration of an overlap feed sign detection device according to a second exemplary embodiment.

FIG. 8 is a block diagram showing an example of a functional configuration of the overlap feed sign detection device 40. Referring to FIG. 8, the overlap feed sign detection device 40 has a protrusion amount detection section 41, an overlap feed sign detection section 42, a processing execution section 43, and a type discrimination section 44.

The type discrimination section 44 discriminates the type of a transport subject being loaded in the loading portion 1. In this case, the transport subject is a sheet, and the type discrimination section 44 discriminates the type of the sheet (that is, sheet type), such as the material of the sheet (that is, sheet material) or the basis weight of the sheet. The type discrimination section 44 may discriminate the sheet type based on sheet type information (for example, sheet type setting information for each sheet feed tray) for set by the user, or may discriminate the sheet type based on the detection result of glossiness or transmission characteristics of the sheet by using a sheet type sensor (not shown).

The protrusion amount detection section 41 is the same as the protrusion amount detection section 31 of the first exemplary embodiment.

In one aspect, the protrusion amount detection section 41 stores the detection result of the protrusion amount for each sheet type based on the discrimination result of the type discrimination section 44.

In the example of FIG. 8, the protrusion amount detection section 41 includes a sheet feed start detection section 41*a*, a sheet arrival detection section 41*b*, a transport time measurement section 41*c*, a reference time storage section 41*d*, a difference calculation section 41*e*, and a time series data storage section 41*f*.

The sheet feed start detection section 41*a*, the sheet arrival detection section 41*b*, the transport time measurement section 41*c*, the reference time storage section 41*d*, and the difference calculation section 41*e* are the same as those in the first exemplary embodiment. Meanwhile, the reference time storage section 41*d* may store a reference time set for each sheet type considering that the transport speed or the transport time differs depending on the sheet type. The difference calculation section 41*e* may calculate a difference based on the reference time corresponding to the sheet type to be transported based on the discrimination result of the type discrimination section 44.

The time series data storage section 41*f* sequentially stores the difference, which is the calculation result of the difference calculation section 41*e*, for each sheet type based on the discrimination result of the type discrimination section 44, and stores time series data for each sheet type. In the example of FIG. 8, the time series data storage section 41*f* stores time series data TSD1, TSD2, TSD3, . . . for the respective sheet types.

The overlap feed sign detection section 42 carries out detection of the sign of overlap feed or determination of deterioration of the separating unit for each sheet type based on the discrimination result of the type discrimination section 44 and the detection result of the protrusion amount. Specifically, the overlap feed sign detection section 42 carries out detection of the sign of overlap feed or determination of deterioration of the separating unit for each sheet type based on multiple times of detections results of the protrusion amount. For example, the overlap feed sign detection section 42 carries out determination of the sign of overlap feed or determination of deterioration of the separating unit for each sheet type based on time series data corresponding to the sheet type which is stored in the time series data storage section 41*f*.

The contents other than the above description of the overlap feed sign detection section 42 are the same as the first exemplary embodiment. Meanwhile, the overlap feed sign detection section 42 may use a threshold value or reference set for each sheet type in sign detection or deterioration determination considering that the absorption force or frictional resistance differs in accordance with the sheet types. When the occurrence frequency of the abnormal value (or the abnormal value and the abnormal value group) is higher than the reference, the overlap feed sign detection section 42 determines whether or not the occurrence frequency of the abnormal value (or the abnormal value and the abnormal value group) in a different sheet type is higher than the reference. In a different sheet type, when the occurrence frequency of the abnormal value is higher than the reference, it may be determined that the separating unit is deteriorated, and when the occurrence frequency of the abnormal value is not higher than the reference, it may be determined that an unsuitable sheet (for example, an irregular sheet) is used. That is, when in two or more sheet types, the occurrence frequency of the abnormal value is higher than the reference, the overlap feed sign detection section 42 may determine that the separating unit is deteriorated.

The processing execution section 43 has a same configuration as the first exemplary embodiment.

Figure 9:
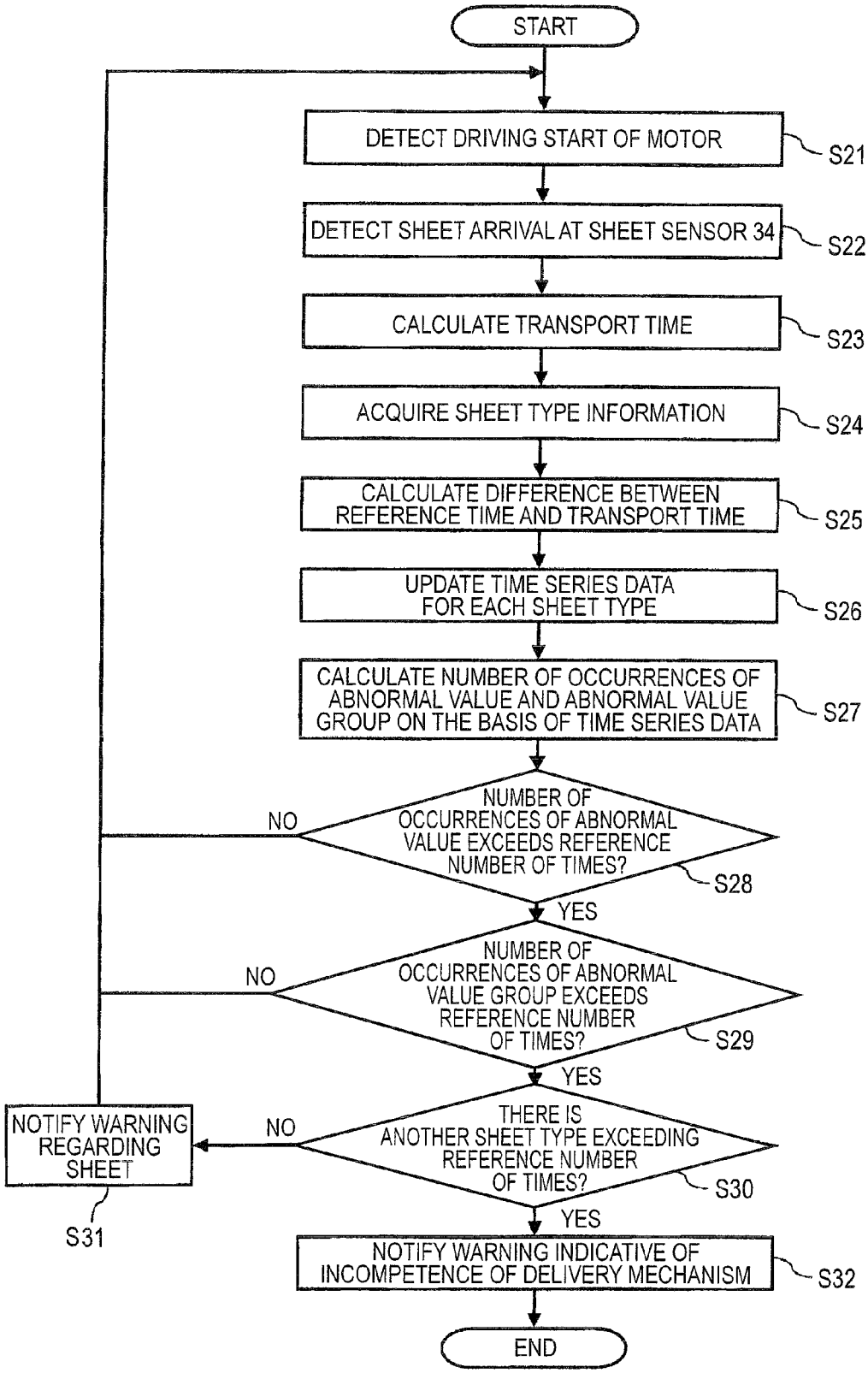
FIG. 9 is a flowchart showing an example of an operation of the overlap feed sign detection device according to the second exemplary embodiment.

FIG. 9 is a flowchart showing an example of the operation of the overlap feed sign detection device 40. Hereinafter, an example of the operation of the overlap feed sign detection device 40 will be described with reference to FIG. 9.

In Step S21, the overlap feed sign detection device 40 detects the driving start of the motor for driving the pickup roller 22. Note that the overlap feed sign detection device 40 is in a standby state until the driving start is detected.

In Step S22, the overlap feed sign detection device 40 detects the sheet arrival at the sheet sensor 34 by using the sheet sensor 34.

In Step S23, the overlap feed sign detection device 40 calculates the transport time from the sheet feed start to the sheet sensor 34 based on the timing of the sheet feed start detected in Step S21 and the timing of the sheet arrival detected in the Step S22.

In Step S24, the overlap feed sign detection device 40 acquires information indicative of the type of a sheet to be transported.

In Step S25, the overlap feed sign detection device 40 calculates a difference between the reference time which is stored in advance, and the transport time which is calculated in Step S23. In this case, the reference time corresponding to sheet type may be used.

In Step S26, the overlap feed sign detection device 40 accumulates the difference calculated in Step S25. Specifically, the overlap feed sign detection device 40 updates time series data corresponding to the sheet type discriminated in Step S24 based on the calculated difference. In this case, the number of time series data is fixed for a predetermined number of times, and the overlap feed sign detection device 40 erases oldest differential data when new differential data is added to time series data. Therefore, time series data retains data for the predetermined number of times from latest data.

In Step S27, the overlap feed sign detection device 40 evaluates the distribution (occurrence frequency) of time series data of the difference updated in Step S26. Specifically, the overlap feed sign detection device 40 specifies a differential value (abnormal value), which exceeds a prescribed threshold value, from among differential values included in time series data, and calculates the number of occurrences of the abnormal value from the predetermined number of times and the number of occurrences of the abnormal value group from the predetermined number of times. In this case, the threshold value corresponding to sheet type may be used, In Step S28, the overlap feed sign detection device 40 determines whether or not the number of occurrences of abnormal values calculated in the Step S27 exceeds the prescribed reference number of times. When the number of occurrences does not exceed the reference number of times (S28: NO), the process returns to Step S21, and when the number of occurrences exceeds the reference number of times (S28: YES), the process progresses to Step S29. In this case, the reference time corresponding to sheet type may be used.

In Step S29, the overlap feed sign detection device 40 determines whether or not the number of occurrences of abnormal value groups calculated in the Step S27 exceeds the prescribed reference number of times. When the number of occurrences does not exceed the reference number of times (S29: NO), the process returns to Step S21, and when the number of occurrences exceeds the reference number of times (S29: YES), the process progresses to Step S30. In this case, the reference number of times corresponding to sheet type may be used.

In Step S30, the overlap feed sign detection device 40 determines whether or not the occurrence frequencies of the abnormal value and the abnormal value group exceed the reference number of times in a different sheet type. In a different sheet type, when the occurrence frequencies of the abnormal value and the abnormal value group do not exceed the reference number of times (S30: NO), the process progresses to Step S31, and when the occurrence frequencies of the abnormal value and the abnormal value group exceed the reference number of times (S30: YES), the process progresses to Step S32. Note that the different sheet type may be, for example, a different specific sheet type, all other sheet types, different sheet types, or the like.

In Step S31, the overlap feed sign detection device 40 notifies a warning regarding the sheet. For example, a warning which requests the user to confirm the sheet is notified.

In Step S32, the overlap feed sign detection device 40 notifies the user or the transport control device 27 of a warning indicative of incompetence of the feed mechanism or deterioration of the separating unit.

The invention is not limited to the foregoing exemplary embodiments, and various modifications may be made within the scope without departing from the subject matter of the invention.

For example, while in the foregoing exemplary embodiments, the description has been made regarding an image forming apparatus, the invention may be applied to an apparatus other than the image forming apparatus, for example, an automatic document feeder or the like. The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A transport device comprising:

a feed unit that feeds transport subjects being loaded in a loading portion one by one in a transport direction;

a protrusion amount detection unit that detects a protrusion amount of the transport subjects from the loading portion in the transport direction; and an overlap feed sign detection unit that detects a sign of occurrence of overlap feed of the transport subjects based on a detection result of the protrusion amount, wherein the feed unit includes a separating unit that gives a force opposite to the transport direction with respect to a transport subject, which is unintentionally fed along with a transport subject to be transported, at a separating portion so as to separate the unintentionally fed transport subject from the transport subject to be transported, and when the transport subject being loaded in the loading portion protrudes beyond the separating portion, the overlap feed sign detection unit determines that the separating unit is deteriorated based on the detection result of the protrusion amount.

2. The transport device according to claim 1, wherein the overlap feed sign detection unit determines that there is a sign of occurrence of overlap feed when an occurrence frequency of the protrusion amount which exceeds a prescribed threshold value is higher than a prescribed reference.

3. The transport device according to claim 2, further comprising:

a type discrimination unit that discriminates types of the transport subjects being loaded in the loading portion, wherein the overlap feed sign detection unit performs sign detection or deterioration determination for each type of the transport subject based on the discrimination result of the types of the transport subjects and the detection result of a protrusion amount for each type of the transport subject.

4. The transport device according to claim 1, wherein when the occurrence frequency of a protrusion amount which exceeds the separating portion or a specific position on a downstream side in the transport direction from the separating portion is higher than a prescribed reference, the overlap feed sign detection unit determines that the separating unit is deteriorated.

5. The transport device according to claim 4, further comprising:

a type discrimination unit that discriminates types of the transport subjects being loaded in the loading portion, wherein the overlap feed sign detection unit performs sign detection or deterioration determination for each type of the transport subject based on the discrimination result of the types of the transport subjects and the detection result of a protrusion amount for each type of the transport subject.

6. The transport device according to claim 1, further comprising:

a type discrimination unit that discriminates types of the transport subjects being loaded in the loading portion, wherein the overlap feed sign detection unit performs sign detection or deterioration determination for each type of the transport subject based on the discrimination result of the types of the transport subjects and the detection result of a protrusion amount for each type of the transport subject.

7. An overlap feed sign detection device comprising:

a protrusion amount detection unit that detects a protrusion amount of each transport subject being loaded in a loading portion from the loading portion in a transport direction when the transport subjects are fed one by one in the transport direction by a feed unit; and an overlap feed sign detection unit that detects a sign of occurrence of overlap feed based on a detection result of the protrusion amount, wherein the feed unit includes a separating unit that gives a force opposite to the transport direction with respect to a transport subject, which is unintentionally fed along with a transport subject to be transported, at a separating portion so as to separate the unintentionally fed transport subject from the transport subject to be transported, and when the transport subject being loaded in the loading portion protrudes beyond the separating portion, the overlap feed sign detection unit determines that the separating unit is deteriorated based on the detection result of the protrusion amount.

8. A computer readable medium storing a program causing a computer to execute a process for detecting an overlap feed sign, the process comprising:

detecting a protrusion amount of a transport subject being loaded in a loading portion from the loading portion in a transport direction when the transport subjects being loaded in the loading portion are fed one by one in the transport direction by a feed unit; and detecting a sign of occurrence of overlap feed of the transport subjects based on a detection result of the protrusion amount, wherein the feed unit includes a separating unit that gives a force opposite to the transport direction with respect to a transport subject, which is unintentionally fed along with a transport subject to be transported, at a separating portion so as to separate the unintentionally fed transport subject from the transport subject to be transported, and when the transport subject being loaded in the loading portion protrudes beyond the separating portion, the detecting a sign of occurrence of overlap feed includes determining that the separating unit is deteriorated based on the detection result of the protrusion amount.

* * * * *